US010365011B2

(12) United States Patent
Lee et al.

(10) Patent No.: US 10,365,011 B2
(45) Date of Patent: Jul. 30, 2019

(54) OUTDOOR UNIT OF AIR CONDITIONER

(71) Applicant: Samsung Electronics Co., Ltd., Suwon-si (KR)

(72) Inventors: Je Gu Lee, Seoul (KR); Kyeong Ae Lee, Suwon-si (KR); Yi Goo Gong, Suwon-si (KR); Kwon Jin Kim, Suwon-si (KR); Ki Jun Kim, Suwon-si (KR); Sung Jae Kim, Seongnam-si (KR); Yeon-Seob Yun, Hwaseong-si (KR); Jong Min Lee, Suwon-si (KR); Chang-Woo Jung, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/711,475

(22) Filed: Sep. 21, 2017

(65) Prior Publication Data

US 2018/0080681 A1 Mar. 22, 2018

(30) Foreign Application Priority Data

Sep. 22, 2016 (KR) ..... 10-2016-0121484

(51) Int. Cl.

| | |
|---|---|
| ***F24F 13/24*** | (2006.01) |
| ***F24F 11/00*** | (2018.01) |
| ***F24F 11/62*** | (2018.01) |
| ***F24F 11/30*** | (2018.01) |
| ***F24F 1/0003*** | (2019.01) |
| ***F24F 1/16*** | (2011.01) |
| ***F24F 1/22*** | (2011.01) |

(Continued)

(52) U.S. Cl.

CPC ..... *F24F 13/24* (2013.01); *F24F 1/0003* (2013.01); *F24F 1/16* (2013.01); *F24F 1/22* (2013.01); *F24F 1/56* (2013.01); *F24F 11/30* (2018.01); *F24F 11/62* (2018.01); *F24F 11/63* (2018.01)

(58) Field of Classification Search

CPC .. F24F 13/24; F24F 11/62; F24F 11/30; F24F 1/0003; F24F 1/16; F24F 1/22; F24F 1/56; F24F 11/63

See application file for complete search history.

(56) References Cited

U.S. PATENT DOCUMENTS 3,225,567 A * 12/1965 Seiler ..... D04B 15/74 66/228
3,286,481 A * 11/1966 Wrench ..... F24F 11/30 62/202

(Continued)

FOREIGN PATENT DOCUMENTS

| | | |
|---|---|---|
| EP | 1956309 | 8/2008 |
| JP | 2011-231964 | 11/2011 |

(Continued)

OTHER PUBLICATIONS

Extended European Search Report dated Feb. 16, 2018 in European Patent Application No. 17191938.4.

*Primary Examiner* — Melvin Jones
(74) *Attorney, Agent, or Firm* — Staas & Halsey LLP

(57) ABSTRACT

An outdoor unit of an air conditioner includes a current carrying path formed between a control box and an outdoor heat exchanger, and electromagnetic noise generated in the control box is transmitted to the outdoor heat exchanger and efficiently discharged to air through the outdoor heat exchanger.

12 Claims, 7 Drawing Sheets

(51) Int. Cl.
*F24F 1/56* (2011.01)
*F24F 11/63* (2018.01)

(56) References Cited

U.S. PATENT DOCUMENTS

| | | | | |
|---|---|---|---|---|
| 4,367,635 | A * | 1/1983 | Leech | F24F 1/02 62/259.1 |
| 2010/0269518 | A1* | 10/2010 | Burns | F24F 1/22 62/77 |
| 2015/0354840 | A1* | 12/2015 | Yamauchi | F24F 5/0007 165/121 |

FOREIGN PATENT DOCUMENTS

| | | |
|---|---|---|
| KR | 10-0819655 | 4/2008 |
| WO | 2013/122449 | 8/2013 |
| WO | 2014/034564 | 3/2014 |

* cited by examiner

OUTDOOR UNIT OF AIR CONDITIONER

CROSS-REFERENCE TO RELATED APPLICATIONS

This application claims the benefit of Korean Patent Application No. 10-2016-0121484 filed on Sep. 22, 2016, in the Korean Intellectual Property Office, the disclosures of which is incorporated herein by reference.

BACKGROUND

1. Field

Embodiments of the disclosure relate to an outdoor unit of an air conditioner having a control box to transmit power and electric signals.

2. Description of the Related Art

In general, an air conditioner is an apparatus including a refrigeration cycle. In such the air conditioner, there is a separate type air conditioner including an indoor unit disposed in an indoor space and an outdoor unit disposed in an outdoor space.

The outdoor unit of the air conditioner includes an outdoor heat exchanger to exchange heat with outdoor air, a compressor to compress refrigerant, a housing to accommodate the outdoor heat exchanger, and a control box disposed at one side of the housing to receive a connection terminal through which power and electric signals are transmitted to the outdoor unit.

The control box is formed of a metal material in consideration of fire resistance. As described above, since the control box provided with the connection terminal, electromagnetic noise is inevitably generated in the control box.

SUMMARY

It is an aspect of the present disclosure to provide an outdoor unit of an air conditioner capable of more efficiently discharging electromagnetic noise generated in a control box of an outdoor unit to the air.

In accordance with one aspect of the present disclosure, an outdoor unit of an air conditioner includes an outdoor heat exchanger to exchange heat with outdoor air, a housing to accommodate the outdoor heat exchanger, a control box disposed on one side of the housing and formed of metal material, and an current carrying path to electrically connect the control box and the outdoor heat exchanger.

The current carrying path may further include a base plate made of a metal material, a valve plate made of a metal material disposed on a lower side of the control box and configured to contact the base plate, and a metal tape having one end attached to the control box and the other end attached to the valve plate.

The current carrying path may further include a base plate made of a metal material and a metal tape having one end attached to the control box and the other end attached to the base plate.

The outdoor unit according may further include a compressor to compress a refrigerant, and the current carrying path may further include a base plate made of a metal material, and a partition wall made of a metal and provided on the base plate to partition a space inside the housing into a space for the outdoor heat exchanger and a space for the compressor.

The outdoor unit may further include a connection clip formed of a metal material to electrically connect the outdoor heat exchanger and the partition wall.

The outdoor heat exchanger may include a pair of headers each formed in a hollow tube shape and a plurality of tubes arranged in parallel to each other between the pair of headers, and the outdoor unit may further include a mount bracket installed on an upper end of at least one of the pair of headers and fixed to the housing, and a connection clip installed on the mount bracket and electrically connecting the header and the partition wall.

The header may include a plurality of dividers spaced apart from one another to divide the inner space of the header, and the connection clip may include a contact portion configured to enter into the header and contacts the divider, and a support portion supported by the mount bracket.

The mount bracket may include a boss portion protruded from one side thereof and to which a screw is coupled, the support portion may include a support hole to support the boss portion inside, and the partition wall is fixed to the mount bracket by the screw coupled to the boss portion.

The mount bracket may be made of a resin material.

The outdoor heat exchanger may be made of an aluminum material.

The current carrying path may include a wire connecting the connection clip and the control box.

The housing may include a side plate formed in a rectangular shape with a front surface opened and installed on the base plate, a front plate installed on a front surface of the side plate, and a top plate installed on the side plate and the front plate, and the side plate, the front plate, and the top plate may be made of a resin material.

BRIEF DESCRIPTION OF THE DRAWINGS

These and/or other aspects of the disclosure will become apparent and more readily appreciated from the following description of the exemplary embodiments, taken in conjunction with the accompanying drawings, in which.

DETAILED DESCRIPTION

Figure 1:
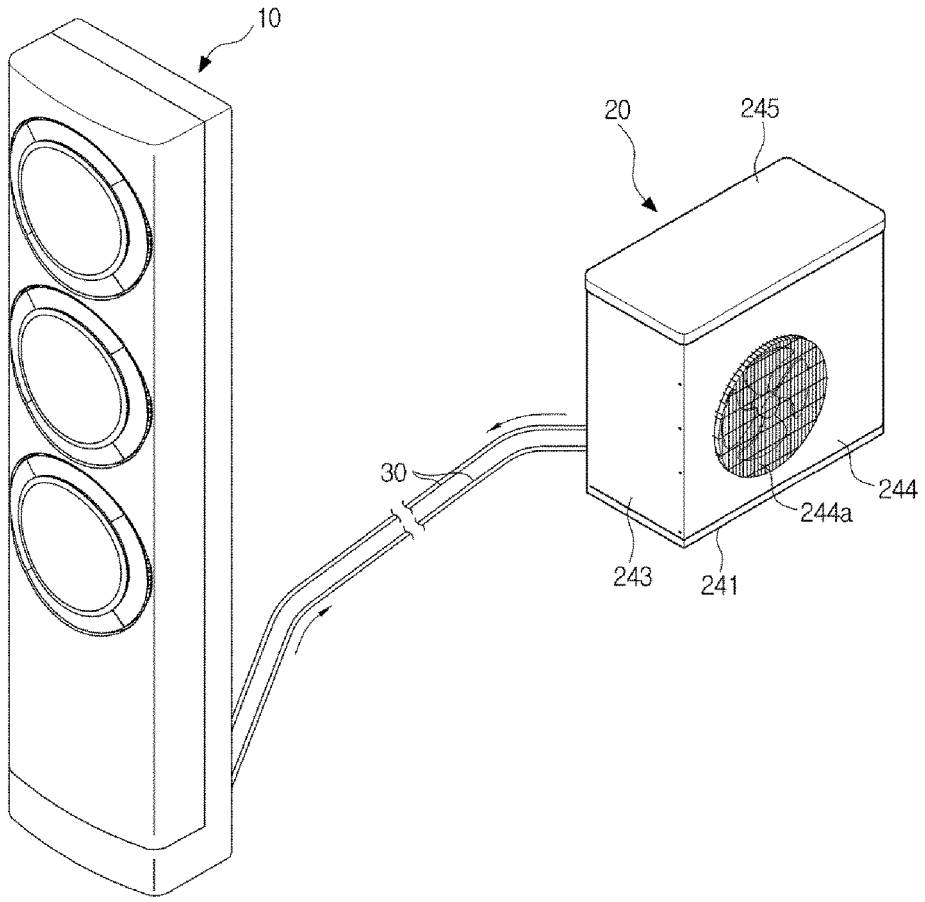
FIG. 1 is a schematic view illustrating an air conditioner according to an embodiment of the present disclosure.

The present disclosure will be described more fully hereinafter with reference to the accompanying figures, in which exemplary embodiments of the present disclosure are shown. As those skilled in the art would realize, the described embodiments may be modified in various different ways, all without departing from the spirit or scope of the present disclosure.

Parts which are not associated with the description are omitted in order to specifically describe the present disclosure, and like reference numerals refer to like elements throughout the specification The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

Hereinafter embodiments of the present disclosure will be described with reference to drawings. In the following detailed description, the terms of "upper side", "lower side", "left side", "right side", "horizontality", "verticality" and the like may be defined by the drawings, but the shape and the location of the component is not limited by the term.

Referring to FIG. 1, an air conditioner according to an embodiment of the present disclosure includes an indoor unit 10 disposed in an indoor space and an outdoor unit 20 disposed in an outdoor space. The indoor unit 10 and the indoor unit 10 are connected to each other through a refrigerant pipe 30 to transfer refrigerant. Although not shown in figures, the indoor unit 10 and the outdoor unit 20 are connected to each other through a wire to transmit power and electric signals.

The indoor unit 10 includes an indoor heat exchanger (not shown) to exchange heat with indoor air, an indoor blowing fan (not shown) to suction and blow indoor air so as to pass the indoor air through the indoor heat exchanger, and an expansion valve (not shown) to decompress and expand the refrigerant.

Figure 2:
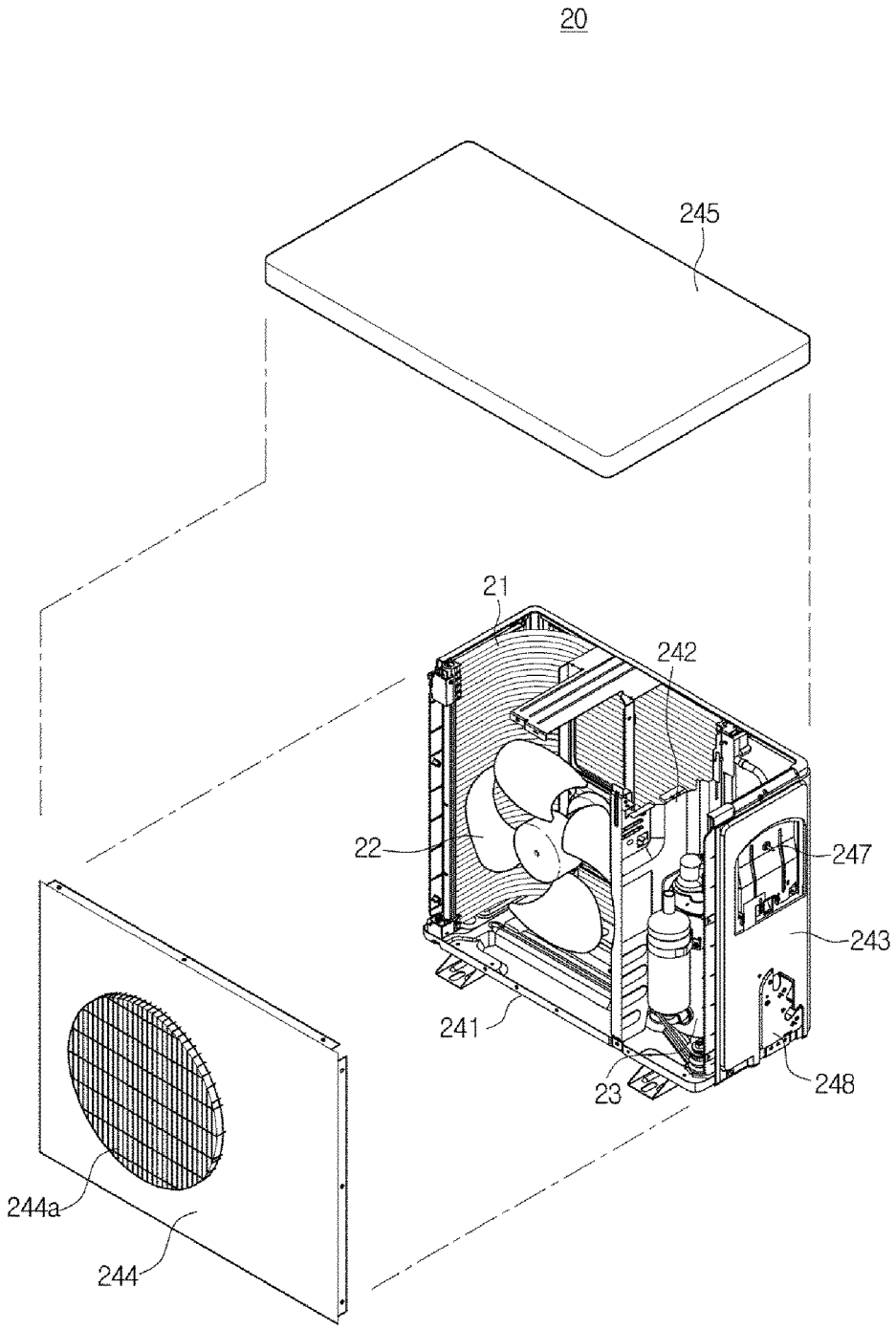
FIG. 2 is an exploded perspective view illustrating an outdoor unit of the air conditioner according to the embodiment of the present disclosure.

Referring to FIG. 2, the outdoor unit 20 includes an outdoor heat exchanger 21 to exchange heat with outdoor air, an outdoor blowing fan 22 (see FIG. 2) to suction and blow the outdoor air so as to pass the outdoor air through the outdoor heat exchanger, a compressor 23 to compress the refrigerant, and a housing 24 to accommodate the outdoor heat exchanger 21, the outdoor blowing fan 22 and the compressor 23 and forming an appearance of the outdoor unit 20.

Figure 3:
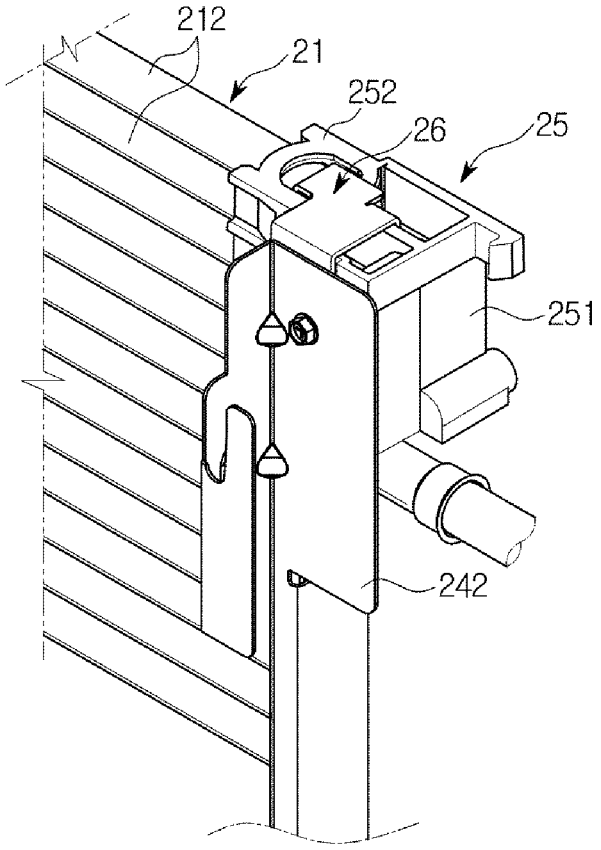
FIG. 3 is a perspective view illustrating an installation state of a mounting bracket and a connection clip in the air conditioner according to the embodiment of the present disclosure.

Referring to FIGS. 2 and 3, the outdoor heat exchanger 21 includes a pair of headers 211 extending vertically and horizontally spaced apart from each other, and a plurality of tubes 212 extending horizontally in parallel to connect between the pair of header 211. The plurality of tubes 212 are vertically spaced parallel to each other. The tubes 212 extend in a substantially L-shape to correspond a rear and one side of the housing 24.

Each of the headers 211 is formed in a substantially hollow tube shape and extends vertically. A plurality of dividers 211*a* (see FIG. 4) is disposed in the header 211 and vertically spaced apart from each other, so that an inner space of the header 211 is divided by the divider 211*a*.

The tube 212 has a flat plate shape, and a plurality of channels (not shown) to guide the refrigerant is provided inside the tube 212.

Both the pair of headers 211 and the tubes 212 forming the outdoor heat exchanger 21 are made of metal material to facilitate heat exchange and heat transfer. In this embodiment, the outdoor heat exchanger 21 is entirely made of aluminum.

Figure 4:
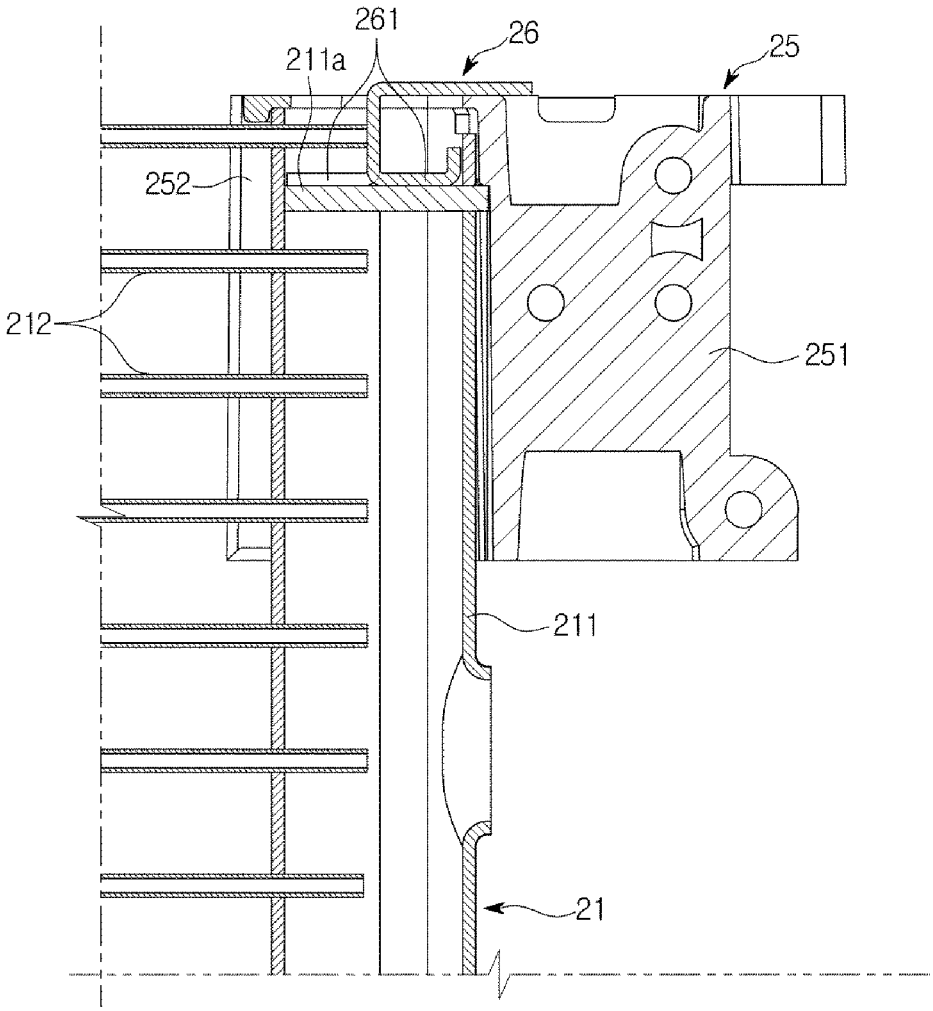
FIG. 4 is a cross-sectional view illustrating the installation state of the mounting brackets and the connection clip in the air conditioner according to the embodiment of the present disclosure.
Figure 5:
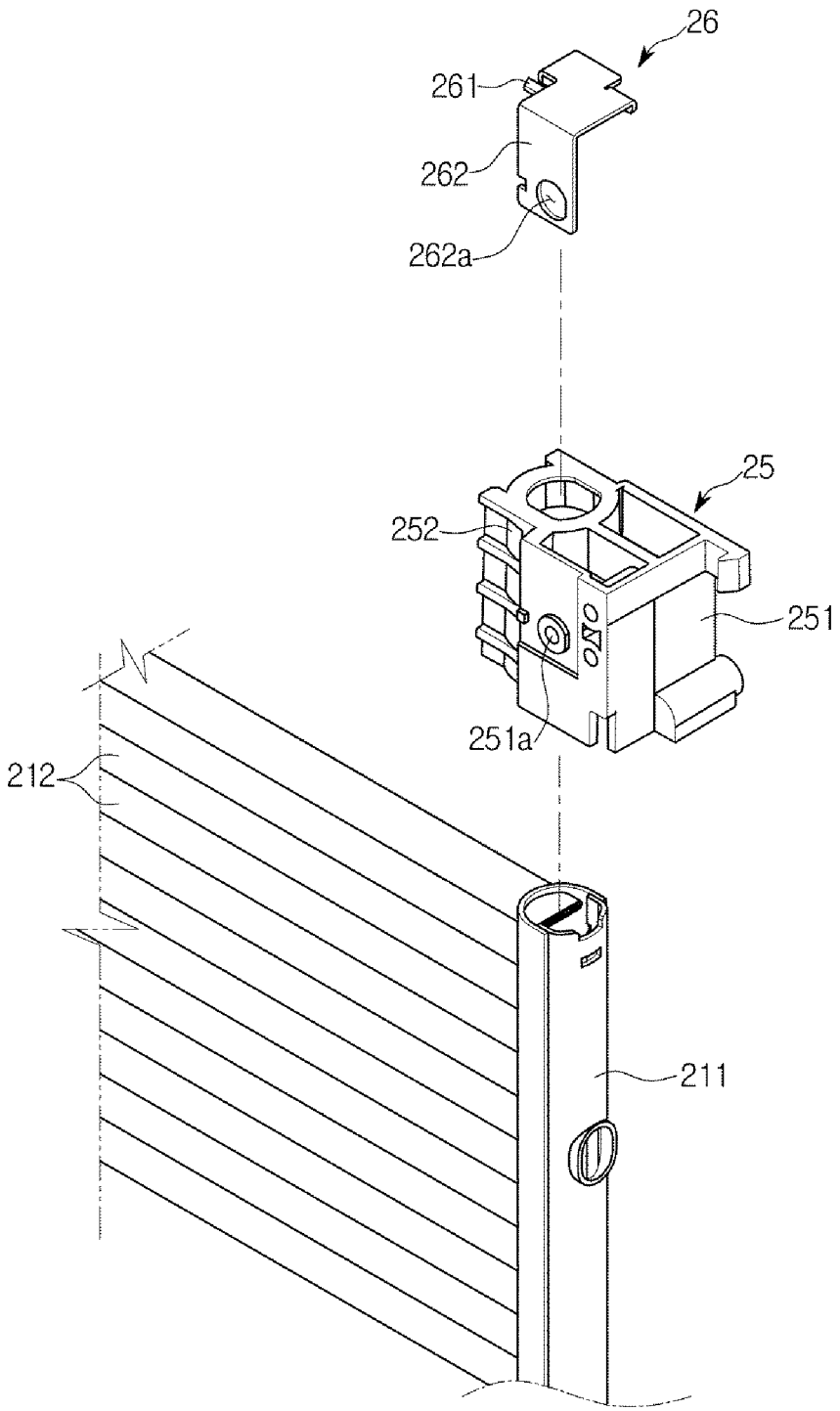
FIG. 5 is an exploded perspective view illustrating the installation state of the mounting bracket and the connection clip in the air conditioner according to the embodiment of the present disclosure.

Referring to FIGS. 4 and 5, mount brackets 25 are disposed at upper and lower ends of the header 211 to maintain a state in which the outdoor heat exchanger 21 is stably installed in the housing 24.

The mount bracket 25 includes a body portion 251 fixed to the housing 24 through a screw, and a mounting portion 252 formed in a hollow tube shape and in which the header 211 is installed. A radial one side of the mounting portion 252 is opened so that the tube 212 may be installed through. Therefore, the outdoor heat exchanger 21 is fixed to the housing 24 through the mount brackets 25.

The mount bracket 25 is made of a resin material so that the outdoor heat exchanger 21 is fixed to the housing 24 while a transmission of the vibration generated in the outdoor heat exchanger 21 to the housing 24 is reduced.

Referring again to FIG. 2, the housing 24 includes a base plate 241 forming a bottom surface thereof and on which the outdoor heat exchanger 21 and compressor 23 are installed, a partition wall 242 provided between the outdoor heat exchanger 21 and the compressor 23 to partition an inner space of the housing 24 into a space in which the outdoor heat exchanger 21 is installed and another space in which the compressor 23 is installed, a side plate 243 formed in a rectangular shape with an opened front side to form a space in which the outdoor heat exchanger 21 and the compressor 23 are installed, a front plate 244 to cover the opened front side of the side plate 243, and a top plate 245 to cover upper sides of the side plate 243 and the front plate 244.

The side plate 243 includes a suction port (not shown) through which the outdoor air is suctioned, and the front plate 244 includes a discharge port 244*a* through which the air heat exchanged with the outdoor heat exchanger 21 is discharged to the outdoor space.

Figure 6:
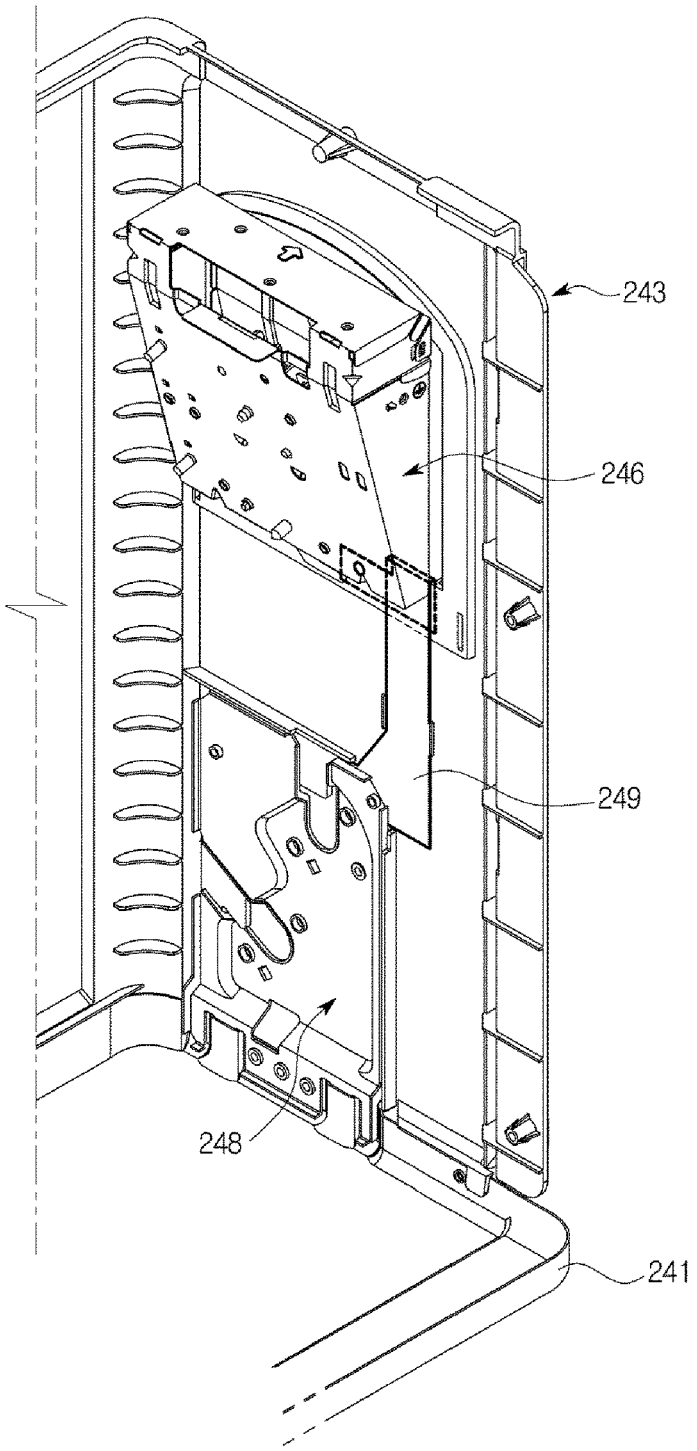
FIG. 6 is a perspective view illustrating an installation state of a control box, a metal tape, and a valve plate in the air conditioner according to the embodiment of the present disclosure.

Referring to FIG. 6, the housing 24 includes a control box 246 provided on an inner surface of the side plate 243, and a valve plate 248 to install a valve (not shown). The refrigerant pipe 30 is connected to the valve plate 248. The control box 246 is disposed on one side of the inside of the side plate 243, and the valve plate 248 is disposed below the control box 246. A lower end of the valve plate 248 is coupled to the base plate 241. That is, the valve plate 248 is electrically connected to the base plate 241.

The control box 246 receives a connection terminal (not shown) to which wire for power and electric signal transmission is connected. The side plate 243 includes an opening for a worker to connect the wire to the connection terminal at an outside of the housing 24. At the side plate 243, a cover 247 (see FIG. 2) is installed to open and close the opening.

The base plate 241, the partition wall 242, and the valve plate 248 of the housing 24 are formed of a metal material in consideration of the strength. The control box 246 and the cover 247 are formed of a metal material in consideration of fire resistance. In this embodiment, the base plate 241, the partition wall 242, the valve plate 248, the control box 246, and the cover 247 are each formed of a steel material.

The outdoor unit 20 is disposed in an outdoor space and exposed to rain or snow, and thus the side plate 243, the front plate 244 and the top plate 245 are made of a resin material. Therefore, the resin material which does not corrode is used. When the side plate 243, the front plate 244 and the top plate 245 of the outdoor unit 20 are made of the resin material, a weight of the outdoor unit 20 is reduced and easily transported and installed.

As described above, when the outdoor heat exchanger 21 made of an aluminum material and the base plate 241 made of steel are directly contact with each other, galvanic corrosion may occur at a portion directly in contact with the base plate 241.

However, the outdoor heat exchanger 21 is installed on the base plate 241 through the mount bracket 25 formed of the resin material. Therefore the direct contact between the outdoor heat exchanger 21 and the base plate 241 and galvanic corrosion are prevented.

As described above, the control box 246 is formed of a metal material and a connection terminal to connect wire is disposed in the control box 246. Therefore, electromagnetic waves and electromagnetic interference (EMI) may inevitably occur in the control box 246.

Therefore, in order to prevent an occurrence of electromagnetic interference, the outdoor unit 20 of the air conditioner is provided with a current carrying path, or conductor, to electrically connect the control box 246 and the outdoor heat exchanger 21, so that the electromagnetic noise generated from the control box 246 is discharged to the air.

That is, the electromagnetic noise generated in the control box 246 is transmitted to the outdoor heat exchanger 21 having a very large contact area with the air through the current carrying path, so that the electromagnetic noise is discharged to the air through the outdoor heat exchanger 21.

Referring to FIG. 5, in order to form the current carrying path, a connection clip 26 which is made of a metal material and electrically connects the outdoor heat exchanger 21 and the partition wall 242 is installed in the outdoor heat exchanger 21.

Referring to FIG. 6, a metal tape 249 to carry current the control box 246 and the base plate 241 is attached to the inner surface of the side plate 243 of the housing 24. In this embodiment, the connection clip 26 is made of an aluminum material so as to prevent galvanic corrosion at a portion contacting the outdoor heat exchanger 21, and the metal tape 249 is made of aluminum tape.

In this embodiment, the connection clip 26 is installed on the mount bracket 25 provided at an upper end of the header 211 adjacent to the partition wall 242. The connection clip 26 has a contact portion 261 which enters an inside of the header 211 and contacts the divider 211*a* of the header 211, and a support portion 262 supported on one side of the mount bracket 25.

The mount bracket 25 has a boss portion 251*a* provided at one side thereof and to which a screw for fixing the partition wall 242 is coupled, and the support portion 262 has a support hole 262*a* to which the boss portion 251*a* is inserted and supported.

Therefore, when the connection clip 26 is mounted on the mount bracket 25, the connection portion 261 is connected to the divider 211*a* of the header 211, and the boss 251*a* is inserted into the support hole 262*a*. When the upper end of the partition wall 242 is fixed to the boss portion 251*a* through the screw in this state, the support portion 262 of the connection clip 26 closely contacts the partition wall 242 and is electrically connected to the connection clip 26.

In this embodiment, the valve plate 248 made of a metal material is disposed below the control box 246, and the valve plate 248 is installed so as to contact the base plate 241. An upper end of the metal tape 249 is attached to the control box 246 and a lower end of the metal tape 249 is attached to the valve plate 248.

The current carrying path is formed between the control box 246 and the outdoor heat exchanger 21 by the metal tape 249, the valve plate 248, the base plate 241, the partition wall 242 and the connection clip 26.

The electromagnetic noise generated in the control box 246 passes through the metal tape 249, the valve plate 248, the base plate 241, the partition wall 242 and the connection clip 26 and transmitted to the outdoor heat exchanger 21. The electromagnetic noise is discharged from the outdoor heat exchanger 21 to the outdoor air passing through the outdoor heat exchanger 21.

Figure 7:
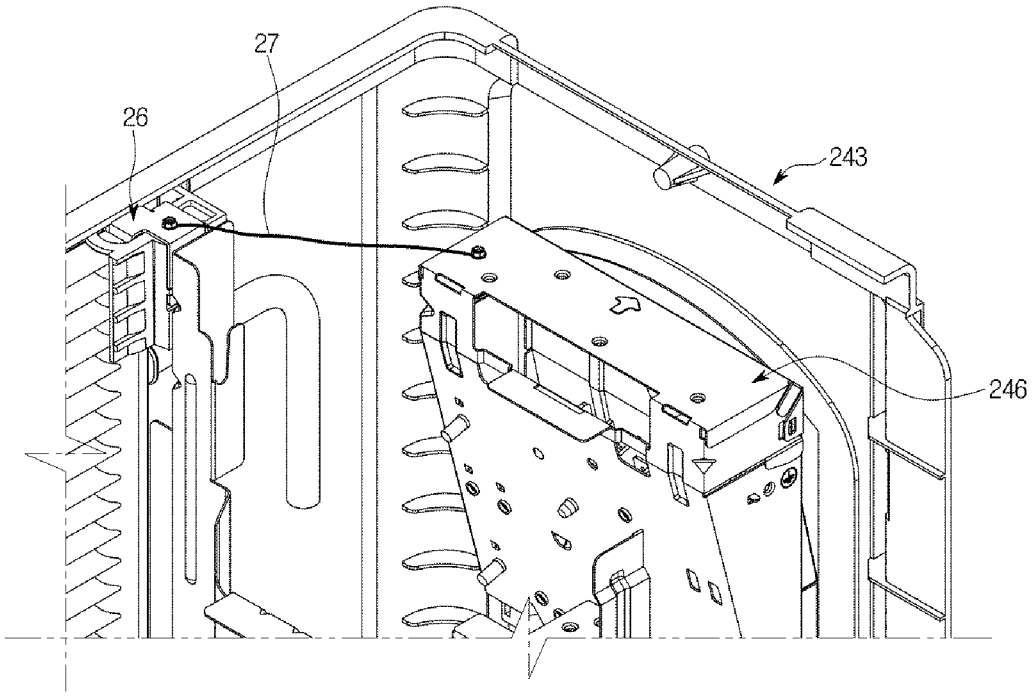
FIG. 7 is a perspective view illustrating a current carrying path applied to an outdoor unit of an air conditioner according to another embodiment of the present disclosure.

In this embodiment, the current carrying path is formed by the connection clip 26, the partition wall 242, the base plate 241, the valve plate 248, and the metal tape 249, but not limited thereto. Referring to FIG. 7, a current carrying path may be formed by a wire having one end installed at the connection clip 26 and the other end installed at the control box 246.

In this embodiment, the valve plate 248 made of a metal material is disposed below the control box 246, and the current carrying path includes the valve plate 248, but this is an example. One end of a metal tape may be attached to the control box 246 and the other end of the metal tape may be attached to the base plate 241 so that the control box 246 may be electrically connected to the base plate 241 only through the metal tape.

As is apparent from the above, the air conditioner according to one aspect of the present disclosure, the current carrying path is formed between the control box and the outdoor heat exchanger disposed in the outdoor unit, so that the electromagnetic noise generated in the control box is transmitted to the outdoor heat exchanger and is discharged to the air through the outdoor heat exchanger.

The present disclosure is not limited to the embodiments described above, and it should be clear to those skilled in the art that various changes and modifications thereto are possible without departing from the spirit and scope of the present disclosure. Therefore, the changes and modifications fall within the scope of the appended claims of the present disclosure.

What is claimed is:

1. An outdoor unit of an air conditioner, the outdoor unit comprising:

an outdoor heat exchanger configured to exchange heat with outdoor air, wherein the outdoor heat exchanger comprises a pair of headers, each formed in a hollow tube shape, and a plurality of tubes arranged in parallel to each other between the pair of headers;

a housing configured to accommodate the outdoor heat exchanger;

a control box disposed on the housing and formed of a metal material, and a current carrying path electrically connecting the control box to at least one of the pair of headers of the outdoor heat exchanger.

2. An outdoor unit of an air conditioner, the outdoor unit comprising:

an outdoor heat exchanger configured to exchange heat with outdoor air;

a housing configured to accommodate the outdoor heat exchanger;

a control box disposed on the housing and formed of a metal material, and a current carrying path electrically connecting the control box to the outdoor heat exchanger, wherein the current carrying path comprises:

a base plate made of a metal material, a valve plate made of a metal material, disposed on a lower side of the control box, and configured to contact the base plate, and a metal tape connecting the control box to the valve plate.

3. An outdoor unit of an air conditioner, the outdoor unit comprising:

an outdoor heat exchanger configured to exchange heat with outdoor air;

a housing configured to accommodate the outdoor heat exchanger;

a control box disposed on the housing and formed of a metal material, and a current carrying path electrically connecting the control box to the outdoor heat exchanger, wherein the current carrying path comprises a base plate made of a metal material and a metal tape connecting the control box to the base plate.

4. The outdoor unit according to claim 1, further comprising a compressor configured to compress a refrigerant, wherein the current carrying path comprises a base plate made of a metal material, and a partition wall made of a metal material and provided on the base plate to partition a space inside the housing into a space for the outdoor heat exchanger and a space for the compressor.

5. The outdoor unit according to claim 4, further comprising a connection clip formed of a metal material to electrically connect the outdoor heat exchanger and the partition wall.

6. The outdoor unit according to claim 5, wherein the outdoor unit further comprises:

a mount bracket installed on an upper end of at least one of the pair of headers and fixed to the housing, wherein the connection clip is installed on the mount bracket to electrically connect the header and the partition wall.

7. The outdoor unit according to claim 6, wherein each header of the pair of headers comprises a plurality of dividers spaced apart from one another to divide an inner space of the header, and the connection clip comprises a contact portion configured to enter into the header and contact the divider, and a support portion supported by the mount bracket.

8. The outdoor unit according to claim 7, wherein the mount bracket comprises a boss portion protruded from one side thereof and to which a screw is coupled, the support portion comprises a support hole to support the boss portion inside, and the partition wall is fixed to the mount bracket by the screw coupled to the boss portion.

9. The outdoor unit according to claim 6, wherein the mount bracket is made of a resin material.

10. The outdoor unit according to claim 7, wherein the outdoor heat exchanger is made of an aluminum material.

11. The outdoor unit according to claim 5, wherein the current carrying path further comprises a wire connecting the connection clip and to the control box.

12. The outdoor unit according to claim 1, wherein the housing comprises a side plate formed in a rectangular shape with a front surface opened and installed on the base plate, a front plate installed on a front surface of the side plate, and a top plate installed on the side plate and the front plate, and the side plate, the front plate, and the top plate are made of a resin material.

* * * * *